US011959472B2

(12) United States Patent
Okaguchi

(10) Patent No.: US 11,959,472 B2
(45) Date of Patent: Apr. 16, 2024

(54) PIEZOELECTRIC PUMP DEVICE

(71) Applicant: Murata Manufacturing Co., Ltd., Kyoto (JP)

(72) Inventor: Kenjiro Okaguchi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 279 days.

(21) Appl. No.: 16/910,298

(22) Filed: Jun. 24, 2020

(65) Prior Publication Data

US 2020/0318631 A1 Oct. 8, 2020

Related U.S. Application Data

(63) Continuation of application No. PCT/JP2018/039125, filed on Oct. 22, 2018.

(30) Foreign Application Priority Data

Dec. 26, 2017 (JP) ..... 2017-249326

(51) Int. Cl.

| | |
|---|---|
| ***F04B 45/047*** | (2006.01) |
| ***F04B 43/00*** | (2006.01) |
| ***F04B 43/04*** | (2006.01) |
| ***F04B 43/09*** | (2006.01) |

(52) U.S. Cl.

CPC ..... *F04B 45/047* (2013.01); *F04B 43/0081* (2013.01); *F04B 43/046* (2013.01); *F04B 43/095* (2013.01)

(58) Field of Classification Search

CPC .... F04B 43/095; F04B 43/046; F04B 17/003; F04B 43/1136; F04B 45/047; F04B 43/0081; H01L 41/09

USPC ..... 310/317

See application file for complete search history.

(56) References Cited

U.S. PATENT DOCUMENTS 4,822,250 A 4/1989 Tsubouchi et al.
5,566,709 A * 10/1996 Fujii ..... G21D 3/08 165/286
7,287,965 B2 * 10/2007 Vogeley ..... F04B 43/046 417/413.2
8,314,531 B2 * 11/2012 Sunaga ..... H01L 41/042 310/317

(Continued)

FOREIGN PATENT DOCUMENTS

JP S63297779 A 12/1988
JP S6419184 A 1/1989

(Continued)

OTHER PUBLICATIONS

International Search Report issued in Application No. PCT/JP2018/039125, dated Jan. 8, 2019.

(Continued)

*Primary Examiner* — Essama Omgba
*Assistant Examiner* — Dnyanesh G Kasture
(74) *Attorney, Agent, or Firm* — Pearne & Gordon LLP

(57) ABSTRACT

A pump device includes a piezoelectric pump, a piezoelectric pump, and a driving circuit. The piezoelectric pump is driven at a first frequency when singly driven. The piezoelectric pump is driven at a second frequency when singly driven. The driving circuit drives the piezoelectric pump and the piezoelectric pump at the same driving frequency.

15 Claims, 6 Drawing Sheets

(56) References Cited

U.S. PATENT DOCUMENTS

2003/0222535 A1* 12/2003 Gofman ..... B06B 1/0253 310/316.01
2005/0219288 A1 10/2005 Vogeley et al.
2006/0239844 A1* 10/2006 Nakayama ..... H01L 23/467 257/E23.099
2007/0029896 A1* 2/2007 Ha ..... H02N 2/008 310/317
2007/0046143 A1* 3/2007 Blandino ..... H01L 41/042 310/317
2008/0150393 A1 6/2008 Funakubo
2009/0032703 A1* 2/2009 Russell ..... G01Q 10/065 250/306
2009/0167109 A1* 7/2009 Tomita ..... H04N 5/22521 310/317
2009/0232683 A1* 9/2009 Hirata ..... F04B 43/046 417/413.2
2011/0298401 A1* 12/2011 Murakami ..... H02N 2/142 318/116
2014/0285065 A1 9/2014 Okaguchi
2015/0236236 A1* 8/2015 Lewis ..... B06B 1/0261 601/2
2016/0252406 A1* 9/2016 Sherrit ..... G01K 11/26 374/117
2018/0108825 A1* 4/2018 Chen ..... F04B 49/06

FOREIGN PATENT DOCUMENTS

| | | | |
|---|---|---|---|
| JP | H04121462 | A | 4/1992 |
| JP | 2005-295726 | A | 10/2005 |
| JP | 2007-224837 | A | 9/2007 |
| JP | 2007533902 | A | 11/2007 |
| JP | 2008-160913 | A | 7/2008 |
| JP | 2010-016978 | A | 1/2010 |
| JP | 2016-046613 | A | 4/2016 |
| JP | 6160800 | B1 | 7/2017 |
| WO | 2013/084709 | A1 | 6/2013 |

OTHER PUBLICATIONS

Written Opinion issued in Application No. PCT/JP2018/039125, dated Jan. 8, 2019.

* cited by examiner

PIEZOELECTRIC PUMP DEVICE

This is a continuation of International Application No. PCT/JP2018/039125 filed on Oct. 22, 2018 which claims priority from Japanese Patent Application No. 2017-249326 filed on Dec. 26, 2017. The contents of these applications are incorporated herein by reference in their entireties.

BACKGROUND

Technical Field

The present disclosure relates to a pump device including a plurality of piezoelectric pumps.

Patent Document 1 describes a driving circuit for a piezoelectric element. In a configuration described in Patent Document 1, one driving circuit is connected to one piezoelectric element.

Patent Document 1: U.S. Pat. No. 6,160,800

BRIEF SUMMARY

There may be a case where a plurality of piezoelectric pumps are included in a pump device because, for example, the pump device needs to attain a certain flow rate.

In this case, in a configuration according to the related art, for each of the plurality of piezoelectric pumps, a driving circuit is individually provided. The plurality of driving circuits individually drive the respective piezoelectric pumps.

In a case where the driving circuits individually provided for the respective piezoelectric pumps are used to individually drive the plurality of piezoelectric pumps, various issues arise. For example, the size of the pump device increases, the driving frequencies of the respective driving circuits interfere with each other, resulting in an unstable operation, or unusual noise is generated.

Accordingly, the present disclosure suppresses an increase in size caused by including a plurality of piezoelectric pumps and to address the other shortcomings.

A pump device according to the present disclosure includes a first piezoelectric pump, a second piezoelectric pump, and a driving circuit. The first piezoelectric pump is driven at a first frequency when singly driven. The second piezoelectric pump is driven at a second frequency when singly driven. The driving circuit drives the first piezoelectric pump and the second piezoelectric pump at the same driving frequency.

The first piezoelectric pump and the second piezoelectric pump are electrically connected to the driving circuit in a state where the first piezoelectric pump and the second piezoelectric pump are electrically connected in parallel, and a difference between the first frequency and the second frequency is smaller than a predetermined frequency.

With this configuration, the flow rate of the first piezoelectric pump and the flow rate of the second piezoelectric pump at the driving frequency are added up, and the pump device attains a flow rate higher than the flow rate of the first piezoelectric pump when singly driven and higher than the flow rate of the second piezoelectric pump when singly driven. Further, the driving circuit is shared by the first piezoelectric pump and the second piezoelectric pump, and therefore, an increase in size of the pump device due to an increase in the number of piezoelectric pumps can be suppressed.

In the pump device according to the present disclosure, that the driving frequency can be equal to the first frequency or the second frequency or can be a predetermined frequency between the first frequency and the second frequency.

With this configuration, the flow rate of the pump device further increases, and such an increase in the flow rate can be attained with more certainty.

In the pump device according to the present disclosure, a threshold of the difference between the first frequency and the second frequency can be ±5% of the first frequency.

With this configuration, the flow rate of the pump device further increases. Further, the flow rate increases in a wide frequency band.

In the pump device according to the present disclosure, the first piezoelectric pump can attain a maximum flow rate thereof at the first frequency, and the second piezoelectric pump can attain a maximum flow rate thereof at the second frequency.

With this configuration, the flow rate of the pump device further increases.

In the pump device according to the present disclosure, the driving frequency can be set within a predetermined frequency range that includes a frequency at which a current value of a current flowing through a parallel circuit formed of the first piezoelectric pump and the second piezoelectric pump reaches a maximum value thereof.

With this configuration, the flow rate of the pump device increases.

In the pump device according to the present disclosure, the driving frequency can be set by further using an impedance of the parallel circuit.

With this configuration, the flow rate of the pump device further increases.

In the pump device according to the present disclosure, an output impedance of the driving circuit at the driving frequency can be lower than an input impedance of the first piezoelectric pump and the second piezoelectric pump at the driving frequency and be equal to or lower than an impedance threshold.

With this configuration, a flow rate of the first piezoelectric pump and the second piezoelectric pump equal to or higher than a predetermined value is attained.

In the pump device according to the present disclosure, the impedance threshold can be 1% of the input impedance.

With this configuration, a higher flow rate of the first piezoelectric pump and the second piezoelectric pump is attained.

In the pump device according to the present disclosure, an impedance of the first piezoelectric pump at the driving frequency and an impedance of the second piezoelectric pump at the driving frequency can be equal to or lower than 200Ω.

With this configuration, driving efficiency increases. The driving efficiency is represented by a time during which a predetermined flow rate can be maintained for a power supply having a predetermined capacity. As the time during which the predetermined flow rate can be maintained increases, the driving efficiency becomes higher.

In the pump device according to the present disclosure, the impedance of the first piezoelectric pump at the driving frequency and the impedance of the second piezoelectric pump at the driving frequency can be equal to or higher than 100Ω.

With this configuration, damage to the first piezoelectric pump and the second piezoelectric pump due to an overcurrent can be suppressed.

The pump device according to the present disclosure may have the following configuration. The driving circuit includes a resistance element, a control circuit, and a driving voltage applying circuit. The resistance element is connected in series to a parallel circuit formed of the first piezoelectric pump and the second piezoelectric pump. The control circuit uses a voltage of the resistance element to measure a current value of a current flowing through the parallel circuit, and outputs a control voltage based on the current value. The driving voltage applying circuit uses the control voltage to apply a driving voltage to the first piezoelectric pump and the second piezoelectric pump.

With this configuration, an external driving circuit is implemented.

In the pump device according to the present disclosure, a frequency of the control voltage can be set to a driving frequency at which the current value becomes close to a maximum thereof.

With this configuration, the flow rate of the pump device increases in the form in which the external driving circuit is used.

The pump device according to the present disclosure may have the following configuration. The driving circuit includes an amplifying circuit, a phase inverting circuit, a resistance element, a differential circuit, and a filter circuit. The amplifying circuit outputs a first driving signal to be given to the first piezoelectric pump and the second piezoelectric pump. The phase inverting circuit inverts a phase of the first driving signal and outputs a second driving signal to be given to the first piezoelectric pump and the second piezoelectric pump. The resistance element is connected between a parallel circuit formed of the first piezoelectric pump and the second piezoelectric pump and the amplifying circuit. To the differential circuit, a voltage between two ends of the resistance element is input. The filter circuit removes from an output of the differential circuit a harmonic component that acts on the first piezoelectric pump and the second piezoelectric pump, and gives the output to the amplifying circuit.

With this configuration, a self-driving circuit is implemented.

In the pump device according to the present disclosure, the driving frequency can be determined on the basis of an impedance of the first piezoelectric pump and the second piezoelectric pump and an impedance of the filter circuit.

With this configuration, the flow rate of the pump device increases in the form in which the self-driving circuit is used.

According to the present disclosure, it is possible to suppress an increase in size caused by including a plurality of piezoelectric pumps and to address the other shortcomings.

DETAILED DESCRIPTION

A pump device according to an embodiment of the present disclosure will be described with reference to the drawings. For example, a pump device that conveys air will be described below. The pump device according to the embodiment can be used in conveying of a fluid other than air.

Figure 1:
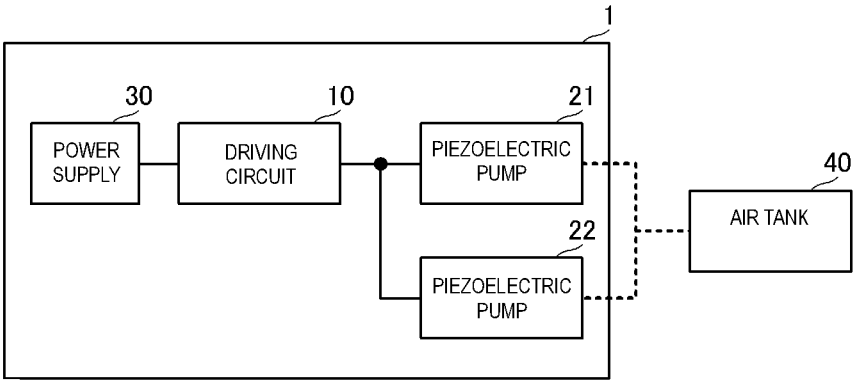
FIG. 1 is a functional block diagram of a pump device 1 according to an embodiment of the present disclosure.

FIG. 1 is a functional block diagram of a pump device 1 according to the embodiment of the present disclosure.

As illustrated in FIG. 1, the pump device 1 includes a driving circuit 10, a piezoelectric pump 21, a piezoelectric pump 22, and a power supply 30.

From the mechanical aspect, the piezoelectric pump 21 and the piezoelectric pump 22, each includes a piezoelectric element and a mechanical part (for example, a casing) that constitutes a flow path. The mechanical part of each of the piezoelectric pump 21 and the piezoelectric pump 22 has a suction port and a discharge port for a fluid. The discharge port of the piezoelectric pump 21 and the discharge port of the piezoelectric pump 22 communicate with an air tank 40.

The piezoelectric element undergoes bending vibration in response to application of a driving voltage. The piezoelectric pump 21 and the piezoelectric pump 22, each uses the bending vibration of the piezoelectric element to cyclically suck air from the suction port and discharge the air from the discharge port at a predetermined pressure. The air discharged from the piezoelectric pump 21 and the air discharged from the piezoelectric pump 22 flow into the air tank 40. At this time, the flow rate of the piezoelectric pump 21 reaches its maximum at a first frequency fp1, and the flow rate of the piezoelectric pump 22 reaches its maximum at a second frequency fp2.

The first frequency can be a frequency at which, in a state where the piezoelectric pump 21 is singly driven, the current value in the piezoelectric pump 21 becomes close to its maximum, and the second frequency is a frequency at which, in a state where the piezoelectric pump 22 is singly driven, the current value in the piezoelectric pump 22 becomes close to its maximum.

Electrically, the piezoelectric pump 21 and the piezoelectric pump 22 are connected in parallel. This parallel circuit is connected to the driving circuit 10. The driving circuit 10 is connected to the power supply 30 and is supplied with power from the power supply 30.

The driving circuit 10 generates and applies to the piezoelectric pump 21 and the piezoelectric pump 22 a driving voltage having a driving frequency fd. The piezoelectric pump 21 and the piezoelectric pump 22 receive the driving voltage having the driving frequency fd, operate in a synchronous manner, and suck and discharge air as described above.

In the above-described configuration, the first frequency fp1 and the second frequency fp2 satisfy the following relationship.

$$(1-X1)\times fp1<fp2<(1+X1)\times fpb1 \quad \text{(expression 1)}$$

When the relationship is represented by the difference in frequency, the difference between the second frequency fp2 and the first frequency fp1 satisfies the following relationship.

$$(-X1)\times fp1<(fp2-fp1)<X1\times fp1 \quad \text{(expression 2)}$$

That is, the difference Δfp between the first frequency fp1 and the second frequency fp2 is within a frequency range of $\pm X1\times 10^2\%$ with reference to the first frequency fp1. X1 can be about 0.05.

Further, the sum of the flow rate (F1) of the piezoelectric pump 21 and the flow rate (F2) of the piezoelectric pump 22 at the driving frequency fd is higher than the maximum flow rate of the piezoelectric pump 21 and the maximum flow rate of the piezoelectric pump 22.

When the above-described relationship is satisfied, the flow rate of the pump device 1 increases.

Figure 2A:
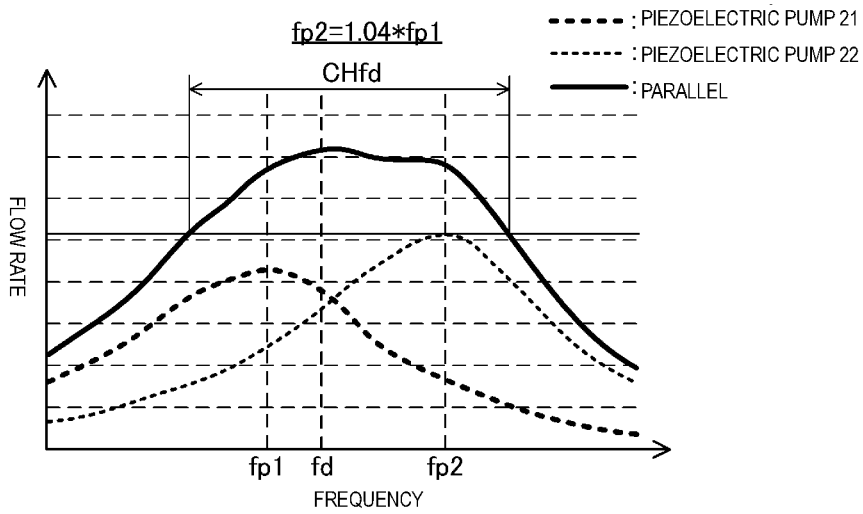
FIG. 2A and FIG. 2B are graphs each indicating the frequency characteristics of the flow rates of two respective piezoelectric pumps connected in parallel.
Figure 2B:
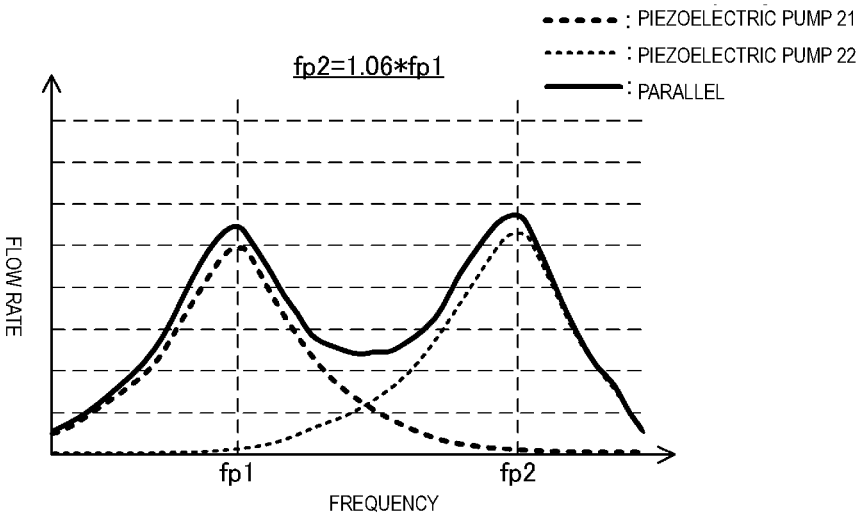

FIG. 2A and FIG. 2B are graphs each indicating the frequency characteristics of the flow rates of the two respective piezoelectric pumps connected in parallel. In FIG. 2A and FIG. 2B, the difference between the frequencies at which the flow rates of the two piezoelectric pumps reach their respective maximums differs. FIG. 2A indicates a case of fp2=1.04×fp1, and FIG. 2B indicates a case of fp2=1.06×fp1. In FIG. 2A and FIG. 2B, the solid line indicates the flow rate of the pump device, and the broken lines indicate the flow rates of the respective piezoelectric pumps. Although not illustrated, it is verified by simulation that, in a case of fp2=1.05×fp1, characteristics similar to those in FIG. 2A are exhibited, and in a case of fp2>1.05×fp1, characteristics similar to those in FIG. 2B are exhibited.

When the first frequency fp1 and the second frequency fp2 satisfy the relationships expressed by (expression 1) and (expression 2), the flow rate (pumping rate) of the pump device 1 is higher than the maximum flow rate of the piezoelectric pump 21 and the maximum flow rate of the piezoelectric pump 22 in a predetermined frequency range CHfd, as illustrated in FIG. 2A.

On the other hand, when the first frequency fp1 and the second frequency fp2 do not satisfy the relationships expressed by (expression 1) and (expression 2), the maximum flow rate of the pump device 1 is only substantially the same as the maximum flow rate of the piezoelectric pump 21 or the maximum flow rate of the piezoelectric pump 22, as illustrated in FIG. 2B.

Therefore, when the driving frequency fd is set within the frequency range CHfd as illustrated in FIG. 2A, the flow rate of the pump device 1 increases. Specifically, when the driving frequency fd is set between the first frequency fp1 and the second frequency fp2, the flow rate of the pump device 1 further increases, as illustrated in FIG. 2A.

Further, the driving frequency fd is set on the basis of a frequency at which the current flowing through the parallel circuit formed of the piezoelectric pump 21 and the piezoelectric pump 22 reaches its maximum. Specifically, the driving frequency fd is set to a frequency fi at which the current flowing through the parallel circuit formed of the piezoelectric pump 21 and the piezoelectric pump 22 reaches its maximum or to a higher frequency fie (for example, about fi+100 Hz) obtained by multiplying the frequency fi corresponding to the maximum current by a predetermined coefficient. At the frequency fi corresponding to the maximum current, driving power supplied to the piezoelectric pump 21 and the piezoelectric pump 22 from the driving circuit 10 can be increased. Accordingly, the flow rate of the pump device 1 further increases. At the frequency fie, variations in a frequency at which an efficiency based on the back pressure, temperature, etc. of the pump device 1 reaches its maximum can be canceled out. Accordingly, the flow rate of the pump device 1 further increases.

Figure 3:
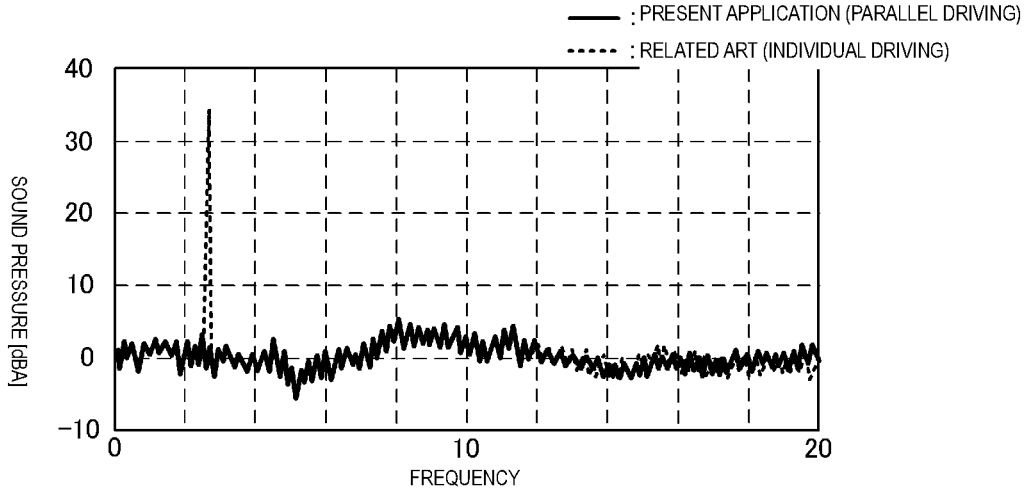
FIG. 3 is a graph indicating the frequency characteristics of the sound pressure of the pump device 1 that includes a plurality of piezoelectric pumps.

In the pump device 1, the piezoelectric pump 21 and the piezoelectric pump 22 are driven at the same driving frequency fd. Accordingly, generation of noise can be suppressed. FIG. 3 is a graph indicating the frequency characteristics of the sound pressure of a pump device that includes a plurality of piezoelectric pumps. In FIG. 3, the solid line indicates the configuration of the present disclosure, and the broken line indicates a configuration according to the related art. In the configuration according to the related art, a plurality of piezoelectric pumps are individually driven by respective driving circuits. At this time, in the configuration according to the related art, the plurality of piezoelectric pumps are driven at respective driving frequencies (different frequencies) at which the flow rates thereof reach their respective maximums.

As indicated by the broken line in FIG. 3, with the configuration according to the related art, vibrations of the plurality of piezoelectric pumps interfere with each other, and noise corresponding to the difference frequency between the driving frequencies is generated at a high sound pressure.

On the other hand, as indicated by the solid line in FIG. 3, in the configuration according to the present disclosure, the plurality of piezoelectric pumps are driven at the same driving frequency, and therefore, noise as in the configuration according to the related art is not generated. Accordingly, with the configuration according to the present disclosure, generation of noise can be suppressed.

In the pump device 1, the output impedance Zo of the driving circuit 10 at the driving frequency fd and the input impedance Zi of the first piezoelectric pump 21 and the second piezoelectric pump 22 at the driving frequency fd can have a relationship described below.

Figure 4:
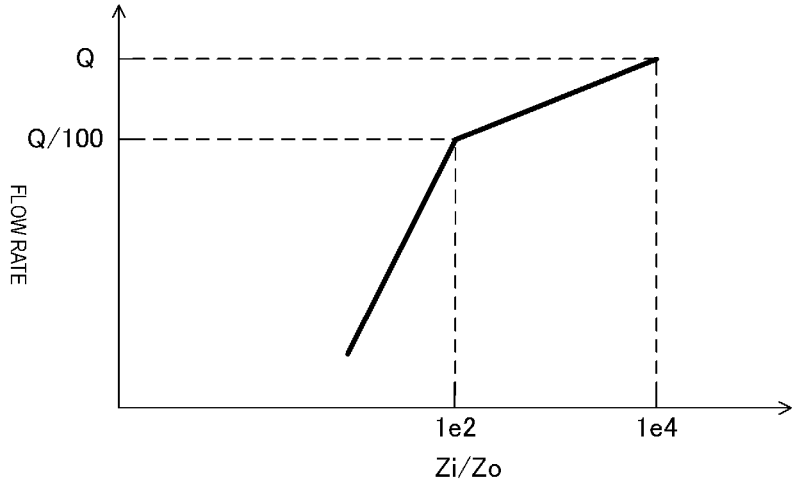
FIG. 4 is a graph indicating a relationship between the ratio between the input impedance of piezoelectric pumps and the output impedance of a driving circuit 10 and a flow rate at a driving frequency.

FIG. 4 is a graph indicating a relationship between the ratio between the input impedance of the piezoelectric pumps and the output impedance of the driving circuit and the flow rate at the driving frequency. As illustrated in FIG. 4, in a case where the input impedance Zi of the piezoelectric pumps with reference to the output impedance Zo of the driving circuit is equal to or lower than 100, that is, in a case where the output impedance Zo of the driving circuit is equal to or higher than 1/100 of the input impedance Zi of the piezoelectric pumps, the flow rate sharply decreases. On the other hand, in a case where the output impedance Zo of the driving circuit is equal to or lower than 1/100 of the input impedance Zi of the piezoelectric pumps, the flow rate decreases to a small degree.

Therefore, when the output impedance Zo of the driving circuit is made equal to or lower than 1/100 of the input impedance Zi of the piezoelectric pumps, a decrease in the flow rate can be suppressed.

The threshold of the ratio of the input impedance Zi of the piezoelectric pumps to the output impedance Zo of the driving circuit can be changed in accordance with the specifications of the flow rate and power required by the pump device 1 and can be set to, for example, 1/50 or less. When the above-described condition that the output impedance Zo of the driving circuit is equal to or lower than 1/100 of the input impedance Zi of the piezoelectric pumps is satisfied, a decrease in the flow rate can be suppressed with more certainty, which is effective.

The output impedance Zo of the driving circuit 10 can be measured with, for example, the following method. First, the output side of the driving circuit 10 is made open, and the voltage Vo at the output terminal is measured. Next, a load having an impedance ZL is connected to the output terminal of the driving circuit 10, and the voltage VL at the output terminal is measured. Then, the output impedance Zo can be calculated by using the following expression.

$$Zo=ZL\times(Vo-VL)/VL \quad \text{(expression 3)}$$

The input impedance Zi of the piezoelectric pumps can be measured with, for example, the following method. To the output terminal of the driving circuit 10, the piezoelectric pumps are connected with a resistance element for current detection interposed therebetween. In this state, the current value Ip of the current flowing through the resistance element and the voltage Vp at the output terminal are measured. Then, the input impedance Zi can be calculated by using the following expression.

$$Zi=Vp/Ip \quad \text{(expression 4)}$$

Note that the above-described voltages and current are rms values.

In the pump device 1, the impedance of the piezoelectric pump 21 and the piezoelectric pump 22 at the driving frequency fd needs to be within a range described below.

Figure 5:
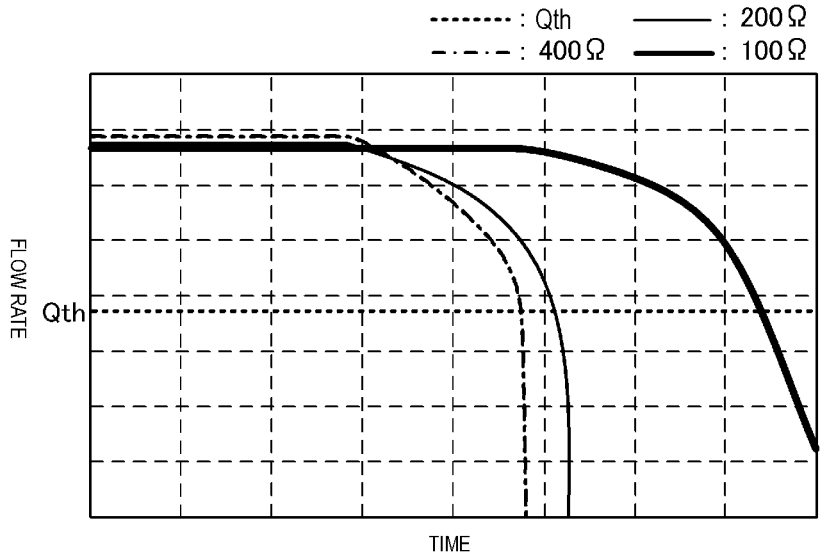
FIG. 5 is a graph indicating changes in a flow rate over time depending on the impedance of piezoelectric pumps.

FIG. 5 is a graph indicating changes in the flow rate over time depending on the impedance of the piezoelectric pumps. In FIG. 5, the thick solid line indicates a case where the impedance of the piezoelectric pumps is 100Ω, the thin solid line indicates a case where the impedance of the piezoelectric pumps is 200Ω, the dot-dash line indicates a case where the impedance of the piezoelectric pumps is 400Ω.

As illustrated in FIG. 5, in the case where the impedance of the piezoelectric pumps is 400Ω, the flow rate changes over time in a manner similar to individual driving according to the related art.

On the other hand, when the impedance of the piezoelectric pumps falls below 400Ω, for example, the flow rate becomes lower than the flow rate Qth (for example, the minimum flow rate required by the pump device 1) at a later time in FIG. 5. Specifically, when the impedance of the piezoelectric pumps falls below 200Ω, the effect of suppressing a decrease in the flow rate increases.

Therefore, when the impedance of the piezoelectric pumps is set to 200Ω or less, a decrease in the flow rate can be suppressed.

The threshold of the impedance of the piezoelectric pumps can be adjusted in accordance with the effect of suppressing the declining of flow rate required by the pump device 1. When the above-described condition that the impedance of the piezoelectric pumps is equal to or lower than 200Ω is satisfied, a decrease in the flow rate in an actual operation can be suppressed with certainty, which is effective.

Further, the impedance of the piezoelectric pumps can be equal to or higher than 100Ω. The reason is as follows. In a current typical piezoelectric element, when the sinusoidal driving voltage is 10 V rms, the upper limit of the current value is 100 mA rms. When a current having a current value equal to or larger than the upper limit flows, a piezoelectric material that constitutes the piezoelectric element may be damaged. When the impedance of the piezoelectric pumps is set to 100Ω or more, damage to the piezoelectric material can be suppressed, and a malfunction in the pump device 1 can be suppressed accordingly.

Now, specific example circuit configurations of the driving circuit will be described with reference to the drawings.

Figure 6:
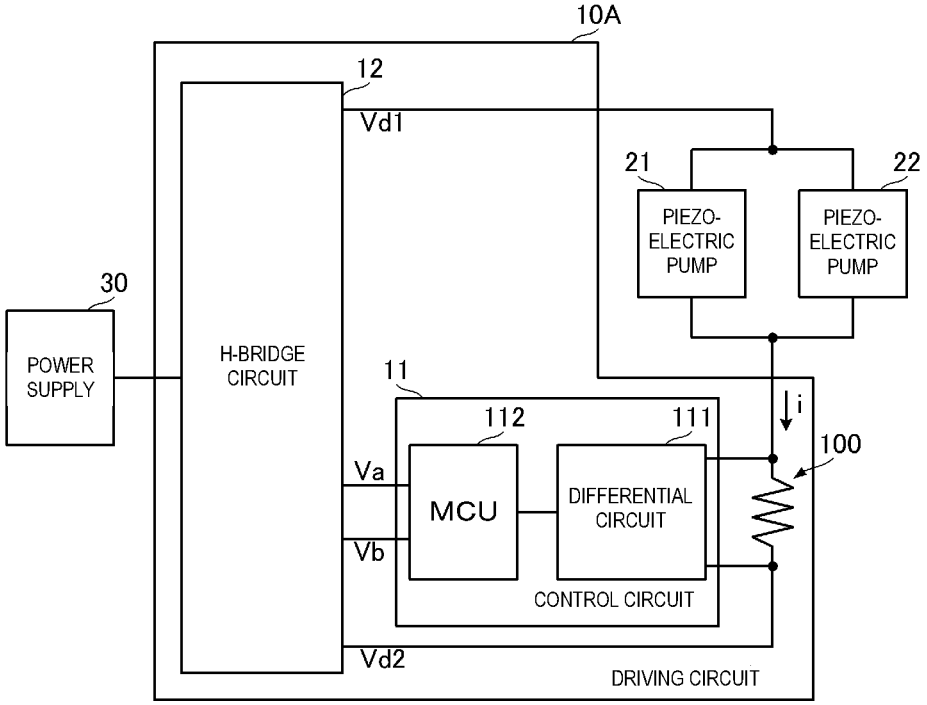
FIG. 6 is a block diagram illustrating a driving circuit 10A in a first form.

FIG. 6 is a block diagram illustrating a driving circuit 10A in a first form.

As illustrated in FIG. 6, the driving circuit 10A includes a control circuit 11, an H-bridge circuit 12, and a resistance element 100. The driving circuit 10A is an external driving circuit.

The control circuit 11 is connected to the H-bridge circuit 12. The first output terminal of the H-bridge circuit 12 is connected to one end of the parallel circuit formed of the piezoelectric pump 21 and the piezoelectric pump 22. The other end of the parallel circuit formed of the piezoelectric pump 21 and the piezoelectric pump 22 is connected to one end of the resistance element 100. The other end of the resistance element 100 is connected to the second output terminal of the H-bridge circuit 12.

The control circuit 11 includes, for example, a differential circuit 111 and an MCU 112. The input terminals (the inverting input terminal and the non-inverting input terminal) of the differential circuit 111 are connected to the respective ends of the resistance element 100. The output terminal of the differential circuit 111 is connected to the MCU 112. The output terminals of the MCU 112 are connected to the H-bridge circuit 12.

To the differential circuit 111, the voltage between the two ends of the resistance element 100 is input. That is, to the input of the differential circuit 111, a voltage corresponding to a current value i in the resistance element 100, that is, the current value i of the current flowing through the parallel circuit formed of the piezoelectric pump 21 and the piezoelectric pump 22, is input. Therefore, the output voltage of the differential circuit 111 changes in accordance with the current value i of the current flowing through the parallel circuit formed of the piezoelectric pump 21 and the piezoelectric pump 22. The output voltage of the differential circuit 111 is input to the MCU 112.

The MCU 112 detects a frequency at which the current value i reaches its maximum on the basis of the output voltage of the differential circuit 111. For example, the MCU 112 detects a frequency at which the absolute value of the output voltage is largest. The MCU 112 sets the detected frequency as the driving frequency fd. At this time, as described above, the MCU 112 may set a higher frequency obtained by multiplying the frequency corresponding to the maximum current by a predetermined coefficient as the driving frequency fd. The MCU 112 generates and outputs to the H-bridge circuit 12 a control voltage Va and a control voltage Vb both of which are based on the driving frequency fd. The control voltage Va and the control voltage Vb are voltages having opposite phases.

The H-bridge circuit 12 is supplied with power from the power supply 30, outputs from the first output terminal a first driving voltage Vd1 corresponding to the control voltage Va, and outputs from the second output terminal a second driving voltage Vd2 corresponding to the control voltage Vb. The first driving voltage Vd1 and the second driving voltage Vd2 are alternating-current signals (rectangular waves) having the driving frequency fd, and have opposite phases.

Accordingly, the first driving voltage Vd1 and the second driving voltage Vd2 having the same driving frequency fd and opposite phases are applied to the respective ends of the parallel circuit formed of the piezoelectric pump 21 and the piezoelectric pump 22. Therefore, the piezoelectric pump 21 and the piezoelectric pump 22 are efficiently driven to attain a desirable flow rate. Further, various issues arise from the configuration according to the related art in which the plurality of piezoelectric pumps are individually driven can be solved.

Figure 7:
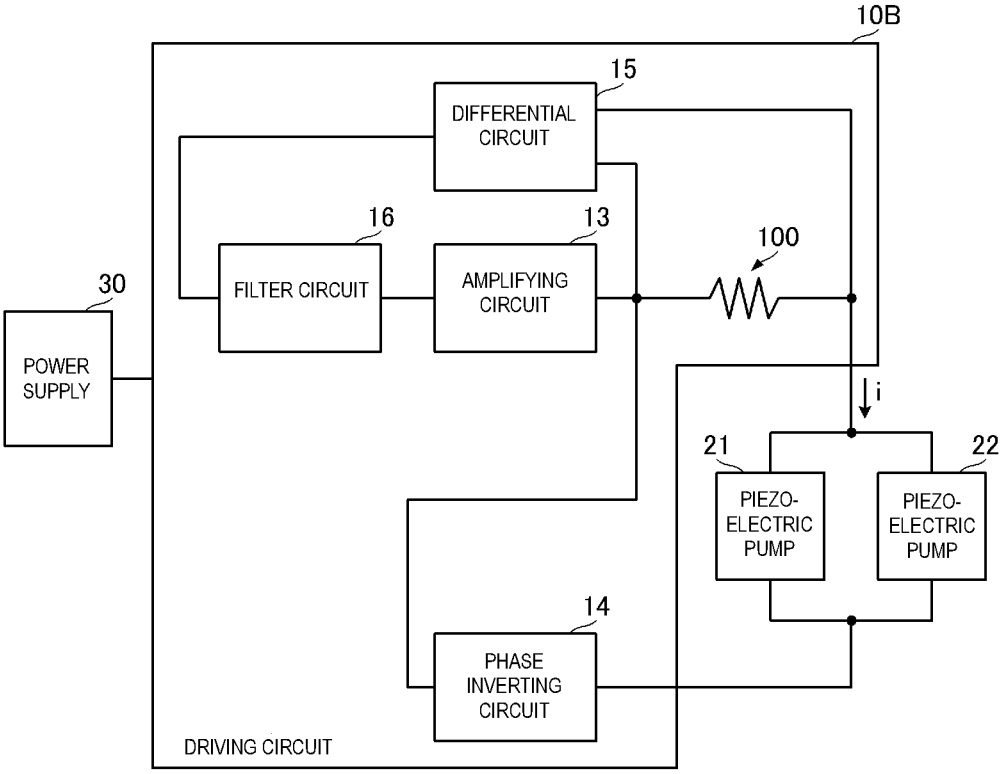
FIG. 7 is a block diagram illustrating a driving circuit 10B in a second form.

FIG. 7 is a block diagram illustrating a driving circuit 10B in a second form.

As illustrated in FIG. 7, the driving circuit 10B includes an amplifying circuit 13, a phase inverting circuit 14, a differential circuit 15, a filter circuit 16, and the resistance element 100. The driving circuit 10B is a self-driving circuit.

The amplifying circuit 13, the phase inverting circuit 14, the differential circuit 15, and the filter circuit 16 are supplied with power from the power supply 30.

The output terminal of the amplifying circuit 13 is connected to one end of the parallel circuit formed of the piezoelectric pump 21 and the piezoelectric pump 22 with the resistance element 100 interposed therebetween. The output terminal of the amplifying circuit 13 is connected also to the input terminal of the phase inverting circuit 14. The output terminal of the phase inverting circuit 14 is connected to the other end of the parallel circuit formed of the piezoelectric pump 21 and the piezoelectric pump 22.

The input terminals (the inverting input terminal and the non-inverting input terminal) of the differential circuit 15 are connected to the respective ends of the resistance element 100. The output terminal of the differential circuit 15 is connected to the input terminal of the filter circuit 16. The output terminal of the filter circuit 16 is connected to the input terminal of the amplifying circuit 13.

The driving circuit 10B operates as a self-oscillation circuit for which the piezoelectric pump 21 and the piezoelectric pump 22 operate as resonators. To the one end of the parallel circuit formed of the piezoelectric pump 21 and the piezoelectric pump 22, the first driving voltage Vd1 having the driving frequency fd is applied, and to the other end thereof, the second driving voltage Vd2 having the driving frequency fd is applied. The first driving voltage Vd1 and the second driving voltage Vd2 are voltages having opposite phases. Therefore, the piezoelectric pump 21 and the piezoelectric pump 22 are efficiently driven to attain a desirable flow rate. Further, various issues arise from the configuration according to the related art in which the plurality of piezoelectric pumps are individually driven can be solved.

The filter circuit 16 is a band-pass filter. The passband of the filter circuit 16 includes the first frequency fp1 of the piezoelectric pump 21, the second frequency of the piezoelectric pump 22, and the driving frequency fd. The attenuation band of the filter circuit 16 includes a resonant frequency in a mode that does not contribute to operations, as pumps, of the piezoelectric elements constituting the piezoelectric pump 21 and the piezoelectric pump 22.

Accordingly, in the driving circuit 10B, a frequency component in the mode that does not contribute to operations as pumps is suppressed, and only a frequency component in a mode that contributes to operations as pumps is fed back, amplified, and applied to the piezoelectric pump 21 and the piezoelectric pump 22. Therefore, the piezoelectric pump 21 and the piezoelectric pump 22 can be efficiently driven.

When the constants (inductance, capacitance, etc.) of the filter circuit 16 are adjusted, the driving frequency fd can be set to a higher frequency obtained by multiplying the frequency corresponding to the maximum current by a predetermined coefficient, as described above. Accordingly, the piezoelectric pump 21 and the piezoelectric pump 22 can be more efficiently driven.

Figure 8:
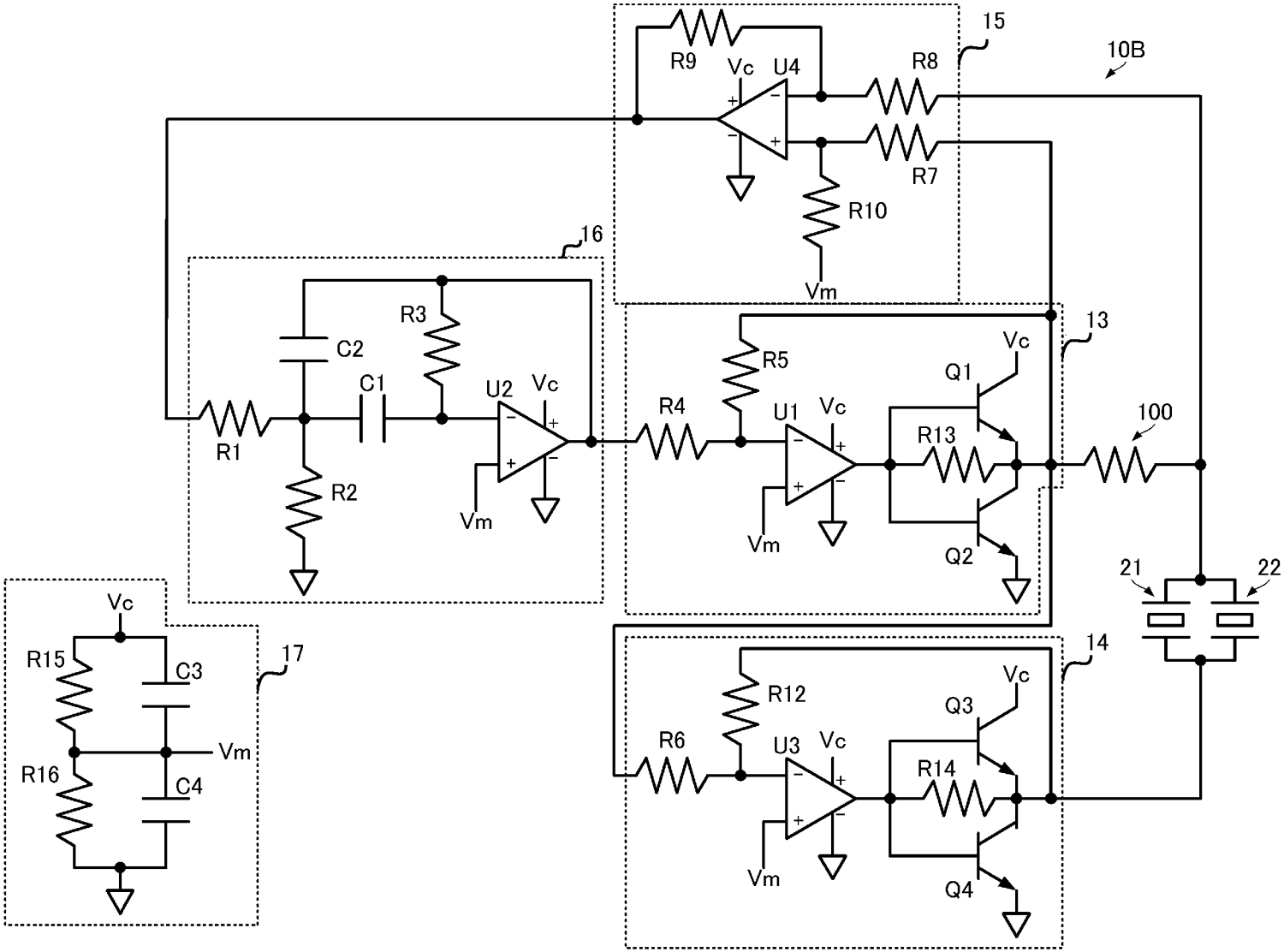
FIG. 8 is a circuit diagram illustrating a specific example circuit of the driving circuit 10B in the second form.

The driving circuit 10B is implemented as, for example, a specific circuit described below. FIG. 8 is a circuit diagram illustrating a specific example circuit of the driving circuit in the second form.

As illustrated in FIG. 8, the amplifying circuit 13 includes an operational amplifier U1, a transistor Q1, a transistor Q2, a resistance element R4, a resistance element R5, and a resistance element R13.

One end of the resistance element R4 is the input end of the amplifying circuit 13. The other end of the resistance element R4 is connected to the inverting input terminal of the operational amplifier U1. To the non-inverting input terminal of the operational amplifier U1, a reference voltage Vm is supplied. To the operational amplifier U1, a driving voltage Vc is supplied. The output terminal of the operational amplifier U1 is connected to the base terminal of the transistor Q1 and the base terminal of the transistor Q2.

To the collector terminal of the transistor Q1, the driving voltage Vc is supplied. The emitter terminal of the transistor Q1 and the collector terminal of the transistor Q2 are connected to each other. The emitter terminal of the transistor Q2 is grounded. Between the base terminals of the transistor Q1 and the transistor Q2, and the connection point of the emitter terminal of the transistor Q1 and the collector terminal of the transistor Q2, the resistance element R13 is connected.

The resistance element R5 is connected between the connection point of the emitter terminal of the transistor Q1 and the collector terminal of the transistor Q2 and the inverting input terminal of the operational amplifier U1.

The connection point of the emitter terminal of the transistor Q1 and the collector terminal of the transistor Q2 is the output end of the amplifying circuit 13, and the output end is connected to one end of the resistance element 100. The other end of the resistance element 100 is connected to one end of the parallel circuit formed of the piezoelectric pump 21 and the piezoelectric pump 22.

The phase inverting circuit 14 includes an operational amplifier U3, a transistor Q3, a transistor Q4, a resistance element R6, a resistance element R12, and a resistance element R14.

One end of the resistance element R6 is the input end of the phase inverting circuit 14 and is connected to the connection point of the emitter terminal of the transistor Q1 and the collector terminal of the transistor Q2. The other end of the resistance element R6 is connected to the inverting input terminal of the operational amplifier U3. To the non-inverting input terminal of the operational amplifier U3, the reference voltage Vm is supplied. To the operational amplifier U3, the driving voltage Vc is supplied. The output terminal of the operational amplifier U3 is connected to the base terminal of the transistor Q3 and the base terminal of the transistor Q4.

To the collector terminal of the transistor Q3, the driving voltage Vc is supplied. The emitter terminal of the transistor Q3 and the collector terminal of the transistor Q4 are connected to each other. The emitter terminal of the transistor Q4 is grounded. Between the base terminals of the transistor Q3 and the transistor Q4, and the connection point of the emitter terminal of the transistor Q3 and the collector terminal of the transistor Q4, the resistance element R14 is connected.

The resistance element R12 is connected between the connection point of the emitter terminal of the transistor Q3 and the collector terminal of the transistor Q4 and the inverting input terminal of the operational amplifier U3.

The connection point of the emitter terminal of the transistor Q3 and the collector terminal of the transistor Q4 is the output end of the phase inverting circuit 14, and the output end is connected to the other end of the parallel circuit formed of the piezoelectric pump 21 and the piezoelectric pump 22.

The differential circuit 15 includes an operational amplifier U4, a resistance element R7, a resistance element R8, a resistance element R9, and a resistance element R10.

To the operational amplifier U4, the driving voltage Vc is supplied. The non-inverting input terminal of the operational amplifier U4 is connected to the output end of the amplifying circuit 13 with the resistance element R7 interposed therebetween. To the non-inverting input terminal of the operational amplifier U4, the reference voltage Vm is supplied through the resistance element R10. The inverting input terminal of the operational amplifier U4 is connected to the other end of the resistance element 100 with the resistance element R8 interposed therebetween. The resistance element R9 is connected between the inverting input terminal and the output terminal of the operational amplifier U4. The output end of the operational amplifier U4 is the output end of the differential circuit 15.

The filter circuit 16 includes an operational amplifier U2, a resistance element R1, a resistance element R2, a resistance element R3, a capacitor C1, and a capacitor C2.

One end of the resistance element R1 is the input end of the filter circuit 16. The other end of the resistance element R1 is connected to one end of the capacitor C1. The connection point of the resistance element R1 and the capacitor C1 is grounded with the resistance element R2 interposed therebetween. The other end of the capacitor C1 is connected to the inverting input terminal of the operational amplifier U2. To the non-inverting input terminal of the operational amplifier U2, the reference voltage Vm is supplied.

The resistance element R3 is connected between the output end of the operational amplifier U2 and the inverting input terminal of the operational amplifier U2. The capacitor C2 is connected between the connection point of the resistance element R1 and the capacitor C1 and the resistance element R3 on the output end side of the operational amplifier U2.

The reference voltage Vm to be supplied to the amplifying circuit 13, the phase inverting circuit 14, the differential circuit 15, and the filter circuit 16 is generated from the driving voltage Vc by a reference voltage generation circuit 17. The reference voltage generation circuit 17 includes a resistance element R15, a resistance element R16, a capacitor C3, and a capacitor C4. The resistance element R15 and the capacitor C3 are connected in parallel, and the resistance element R16 and the capacitor C4 are connected in parallel. These parallel circuits are connected in series. To one end of the series circuit, the driving voltage Vc is supplied. The other end of the series circuit is grounded. The connection point of the parallel circuits is the output end of the reference voltage generation circuit 17, and the reference voltage Vm is output from the output end.

Figure 9:
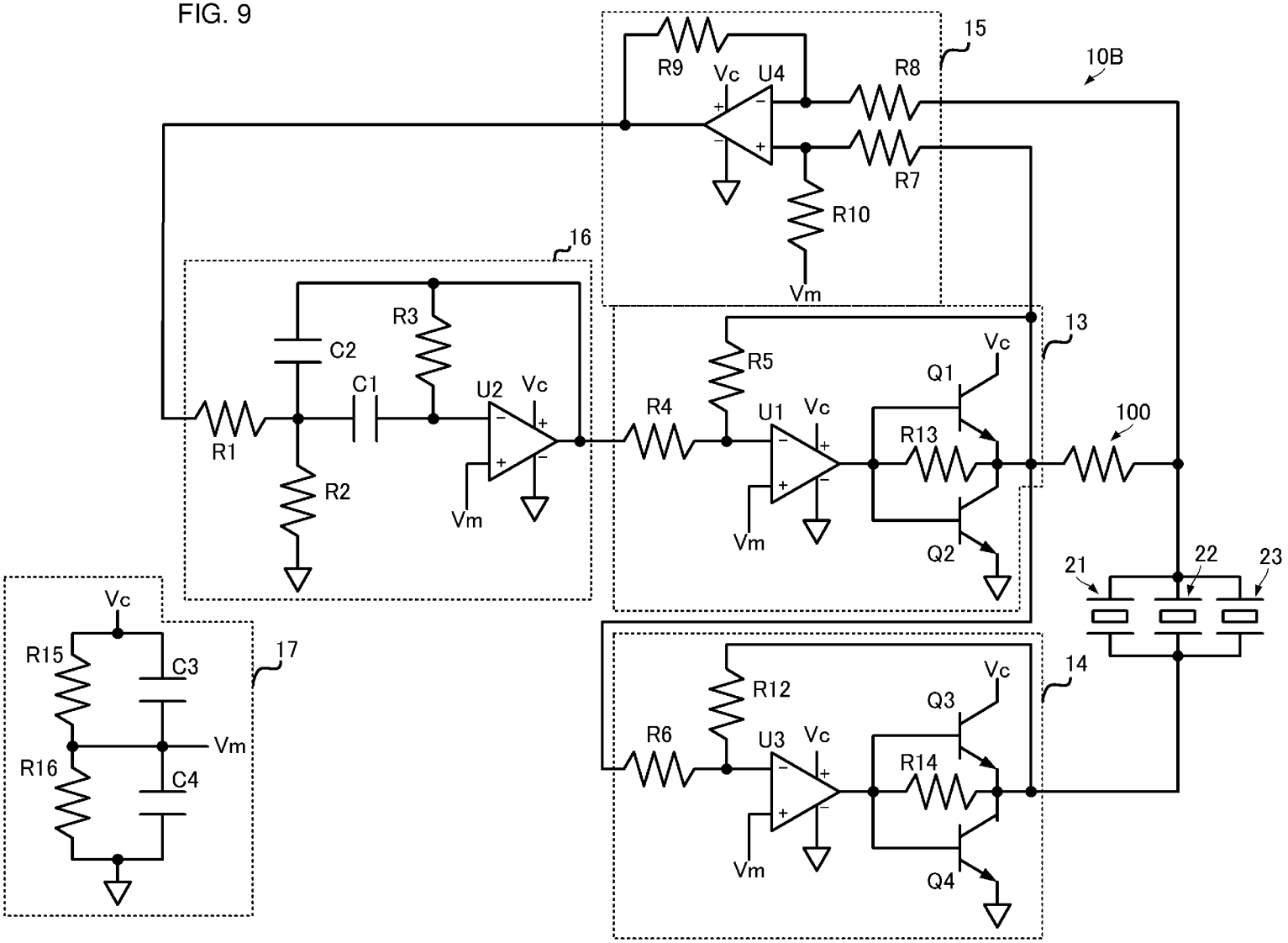
FIG. 9 is a circuit diagram illustrating a specific example circuit of the driving circuit 10B in a third form.

FIG. 9 is a circuit diagram illustrating a specific example circuit of the driving circuit in a third form.

As illustrated in FIG. 9, the configuration of the driving circuit in the third form is different from that of the driving circuit in the second form in that a piezoelectric pump 23 is additionally connected. The basic configuration of the driving circuit in the third form is similar to that of the driving circuit in the second form, and therefore, descriptions of the similar portions are omitted.

As illustrated in FIG. 9, the other end of the resistance element 100 is connected to one end of the parallel circuit formed of the piezoelectric pump 21, the piezoelectric pump 22, and the piezoelectric pump 23. The connection point of the emitter terminal of the transistor Q3 and the collector terminal of the transistor Q4 is the output end of the phase inverting circuit 14, and the output end is connected to the other end of the parallel circuit formed of the piezoelectric pump 21, the piezoelectric pump 22, and the piezoelectric pump 23.

At this time, a third frequency at which the maximum flow rate is attained in the third piezoelectric pump needs to be equal to the first frequency or the second frequency, or needs to be a predetermined frequency between the first frequency and the second frequency.

Also in the driving circuit 10B having the above-described configuration, a frequency component in the mode that does not contribute to operations as pumps is suppressed, and only a frequency component in the mode that contributes to operations as pumps is fed back, amplified, and applied to the piezoelectric pump 21, the piezoelectric pump 22, and the piezoelectric pump 23. Therefore, the piezoelectric pump 21, the piezoelectric pump 22, and the piezoelectric pump 23 can be efficiently driven.

Further, as long as the above-described frequency condition is satisfied, four or more piezoelectric pumps may be connected.

Figure 10:
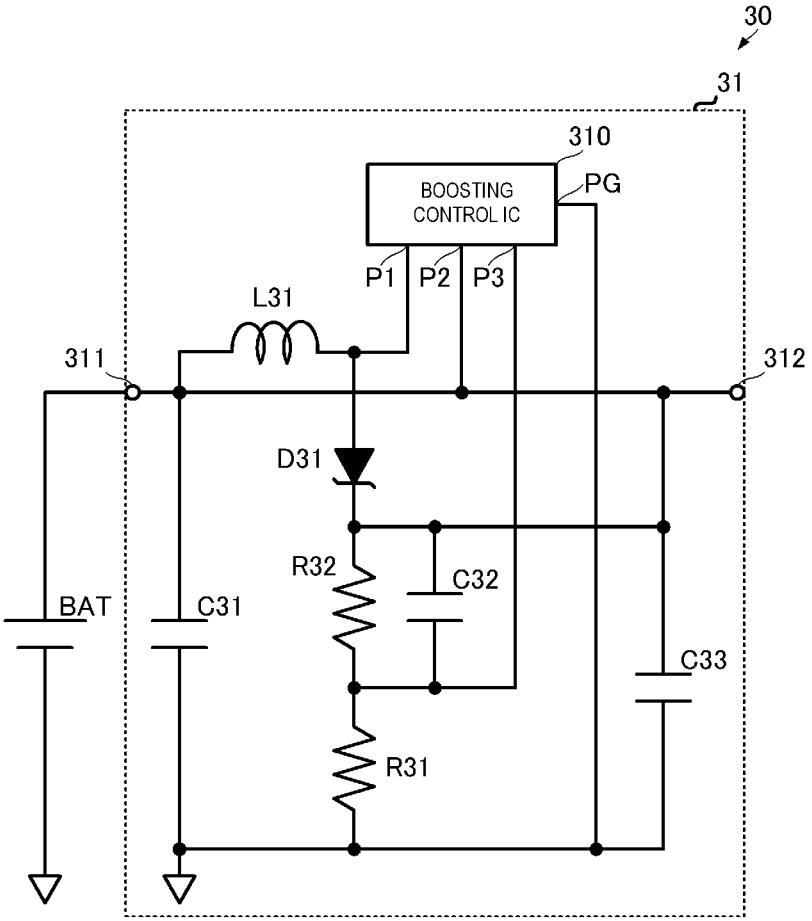
FIG. 10 is a circuit diagram illustrating a specific example circuit of a power supply 30.

The power supply 30 described above is implemented as, for example, a specific circuit described below. FIG. 10 is a circuit diagram illustrating a specific example circuit of the power supply 30.

As illustrated in FIG. 10, the power supply 30 includes a battery BAT and a boosting circuit 31. The boosting circuit 31 includes a boosting control IC 310, an inductor L31, a diode D31, a resistance element R31, a resistance element R32, a capacitor C31, a capacitor C32, and a capacitor C33. The boosting circuit 31 has an input terminal 311 and an output terminal 312.

The input terminal 311 of the boosting circuit 31 is connected to the positive electrode of the battery BAT. The negative electrode of the battery BAT is grounded.

The input terminal 311 is connected to the output terminal 312 and is connected to one end of the inductor L31. The other end of the inductor L31 is connected to the anode of the diode D31. The cathode of the diode D31 is connected to one end of the parallel circuit formed of the resistance element R32 and the capacitor C32. The other end of the parallel circuit formed of the resistance element R32 and the capacitor C32 is grounded with the resistance element R31 interposed therebetween. The one end of the parallel circuit formed of the resistance element R32 and the capacitor C32 is connected to the output terminal 312.

The boosting control IC 310 has a terminal P1 that is connected to the connection point of the inductor L31 and the diode D31, a terminal P2 that is connected to the connecting line connecting the input terminal 311 and the output terminal 312, a terminal P3 that is connected to the other end of the parallel circuit formed of the resistance element R32 and the capacitor C32, and a ground terminal PG. Although not illustrated, the boosting control IC 310 includes a switch circuit that is connected to the terminal P1, the terminal P2, and the terminal P3, and controls continuity, opening, etc. between the inductor L31 and the output terminal 312.

One end of the capacitor C31 is connected to the input terminal 311, and the other end of the capacitor C31 is grounded. One end of the capacitor C33 is connected to the output terminal 312, and the other end of the capacitor C33 is grounded.

With the configuration as described above, for example, the boosting circuit 31 boosts the direct-current voltage of the battery BAT, namely, about 3 [V], to about 28 [V] and outputs the boosted voltage from the output terminal 312.

FIG. 10 illustrates the form in which the power supply 30 is constituted by the battery BAT and the boosting circuit 31; however, the power supply 30 may be replaced by, for example, a direct-current power supply capable of outputting 28 [V]. Further, the boosting circuit 31 is not limited to that of a diode-rectification type as illustrated in FIG. 10, and a boosting circuit of, for example, a synchronous rectification type, a charge pump type, or a linear regulator type may be used.

In the above description, the difference Δfp between the first frequency fp1 and the second frequency fp2 is specified to be within the frequency range of ±5% with reference to the first frequency fp1. However, the difference Δfp may be set to a value other than a value within ±5% on the basis of, for example, the frequency characteristics of the flow rates of the plurality of piezoelectric pumps, the minimum flow rate required by the pump device, and power consumption.

REFERENCE SIGNS LIST

1: pump device
10, 10A, 10B: driving circuit
11: control circuit
12: bridge circuit
13: amplifying circuit
14: phase inverting circuit
15: differential circuit
16: filter circuit
17: reference voltage generation circuit
21, 22, 23: piezoelectric pump
30: power supply
31: boosting circuit
40: air tank
100: resistance element
111: differential circuit
112: MCU
310: boosting control IC

The invention claimed is:

1. A pump device comprising:
a first piezoelectric pump driven at a first frequency when singly driven;
a second piezoelectric pump driven at a second frequency when singly driven; and
a driving circuit configured to drive the first piezoelectric pump and the second piezoelectric pump together at a driving frequency, the driving frequency being the same for the first piezoelectric pump and the second piezoelectric pump, wherein:
the first piezoelectric pump and the second piezoelectric pump are electrically connected in parallel with each other and in series to the driving circuit, and
a difference between the first frequency and the second frequency is less than a predetermined amount, wherein an output impedance of the driving circuit at the driving frequency is less than an input impedance of the first piezoelectric pump and the second piezoelectric pump at the driving frequency, and is equal to or less than an impedance threshold.

2. The pump device according to claim 1, wherein the driving frequency is equal to the first frequency, the second frequency, or a predetermined frequency between the first frequency and the second frequency.

3. The pump device according to claim 1, wherein the difference between the first frequency and the second frequency is ±5% of the first frequency.

4. The pump device according to claim 1, wherein:
the first piezoelectric pump is configured to pump at a first maximum flow rate when driven at the first frequency, and
the second piezoelectric pump is configured to pump at a second maximum flow rate when driven at the second frequency.

5. The pump device according to claim 1, wherein the driving frequency is within a predetermined frequency range, the predetermined frequency range comprising a frequency at which a maximum current flows through a parallel circuit that comprises the first piezoelectric pump and the second piezoelectric pump connected in parallel with each other.

6. The pump device according to claim 5, wherein the driving frequency is based on an impedance of the parallel circuit.

7. The pump device according to claim 1, wherein the impedance threshold is 1% of the input impedance.

8. The pump device according to claim 1, wherein an impedance of the first piezoelectric pump at the driving frequency and an impedance of the second piezoelectric pump at the driving frequency are equal to or less than 200 Ω.

9. The pump device according to claim 8, wherein the impedance of the first piezoelectric pump at the driving frequency and the impedance of the second piezoelectric pump at the driving frequency are equal to or greater than 100 Ω.

10. The pump device according to claim 1, wherein the driving circuit comprises:
a resistance element that is connected in series to a parallel circuit comprising the first piezoelectric pump and the second piezoelectric pump connected in parallel with each other,
a control circuit configured to measure a current flowing through the parallel circuit based on a voltage of the resistance element, and to output a control voltage based on the measured current, and
a driving voltage applying circuit configured to apply a driving voltage to the first piezoelectric pump and the second piezoelectric pump based on the control voltage.

11. The pump device according to claim 10, wherein a frequency of the control voltage is a frequency at which the measured current is a maximum.

12. The pump device according to claim 1, wherein the driving circuit comprises:
an amplifying circuit configured to output a first driving signal to the first piezoelectric pump and the second piezoelectric pump,
a phase inverting circuit configured to invert a phase of the first driving signal and to output a second driving signal to the first piezoelectric pump and the second piezoelectric pump,
a resistance element that is connected between a parallel circuit and the amplifying circuit, the parallel circuit comprising the first piezoelectric pump and the second piezoelectric pump connected in parallel,
a differential circuit to which a voltage across the resistance element is input, and a filter circuit configured to remove a harmonic component from an output of the differential circuit, configured to act on the first piezoelectric pump and the second piezoelectric pump, and configured to supply an output of the filter circuit to the amplifying circuit.

13. The pump device according to claim 12, wherein the driving frequency is based on an impedance of the first piezoelectric pump and the second piezoelectric pump, and an impedance of the filter circuit.

14. The pump device according to claim 1, wherein the difference between the first frequency and the second frequency is less than 5% of the first frequency.

15. The pump device according to claim 1, wherein the sum of a flow rate of the first piezoelectric pump and a flow rate of the second piezoelectric pump at the driving frequency is a combined maximum flow rate.

* * * * *